US006604252B1

(12) United States Patent
Lee et al.

(10) Patent No.: US 6,604,252 B1
(45) Date of Patent: Aug. 12, 2003

(54) AIR MATTRESS WITH ALTERNATE LIFTING FUNCTION AND SIDEGUARDS

(75) Inventors: Daniel Lee, Taipei Hsien (TW); Terry Tu, No. 3-1, Min Chyuan St., Tu-Cheng City, Taipei Hsien (TW)

(73) Assignees: Terry Tu, Taipei Hsien (TW); Apex Medical Corp., Taipei Hsien (TW)

( * ) Notice: Subject to any disclaimer, the term of this patent is extended or adjusted under 35 U.S.C. 154(b) by 0 days.

(21) Appl. No.: 10/151,903

(22) Filed: May 22, 2002

(51) Int. Cl.[7] ..... A47C 27/10; A61G 7/057
(52) U.S. Cl. ..... 5/715; 5/713; 5/732
(58) Field of Search ..... 5/715, 713, 710, 5/732, 706

(56) References Cited

U.S. PATENT DOCUMENTS 1,576,211 A * 3/1926 O'Kane ..... 5/732
1,772,310 A * 8/1930 Hart ..... 5/713
5,611,096 A * 3/1997 Bartlett et al. ..... 5/715
5,781,949 A * 7/1998 Weismiller et al. ..... 5/715
6,085,372 A * 7/2000 James et al. ..... 5/732

* cited by examiner

*Primary Examiner*—Alexander Grosz
(74) *Attorney, Agent, or Firm*—Rosenberg, Klein & Lee

(57) ABSTRACT

An air mattress with alternate lifting function consists of a plurality of air pouches and side pouches. The side pouches are longitudinally located under the transverse air pouches. The side pouches are inflatable alternately to enable two sides of the air mattress moving up and down alternately to give a patient's body lain on the air mattress sideways exercises. The air pouches may be inflated alternately and synchronously with the inflation of the side pouches to alter pressing areas on the patient's body to prevent the patient from suffering harmful effect resulting from impeded blood circulation due to prolonged pressure exerting on the patient's body.

1 Claim, 4 Drawing Sheets

AIR MATTRESS WITH ALTERNATE LIFTING FUNCTION AND SIDEGUARDS

BACKGROUND OF THE INVENTION

1. Field of the Invention

The present invention relates to an air mattress and particularly to an air mattress that has air pouches to generate up and down movements alternately and has side pouches to give a patient lying thereon an inclined sideways exercises and alters patient's body areas that are subject to pressure to prevent the patient from inflicting illness caused by impeded blood circulation under prolonged lopsided pressure.

2. Description of the Prior Art

Air mattresses are commonly used medical instruments to prevent patients who have to lie on beds for a prolonged period of time from suffering bedsores. Conventional air mattresses can be grouped to low-pressure air mattresses and alternate air mattresses. A low-pressure air mattress generally includes a single or a plurality of air pouches, which are filled with low-pressure air. A patient's body can be supported by the air pressure without directly contact the hard bedstead below the air pouches. The alternate air mattress generally includes a plurality of air pouches and has an air pump to inflate and deflate the air pouches alternately.

As the alternate air mattress may contact or not contact patient's body in an alternate manner by inflating or deflating the air pouches, it is more effective to prevent patients from inflicting bedsores than air mattresses that do not have inflatable and adjustable air pouches. However, patients still lie on the alternate air mattresses in a static condition. It is not desirable to patients who are confined to beds for a long period of time.

It is well known that proper exercises can improve blood circulation of human body. In order to prevent patients from inflicting bedsores when confined to beds for a long period of time, Applicant has previously disclosed an alternate and inflatable air mattress, which consists of a plurality of air pouch sets that are inflatable alternately. Each air pouch set has an outer first air pouch, which contains an inner second air pouch. The first air pouch connects to the second air pouch. The first air pouch has a partitioned air chamber A and an air chamber B. Air ducts are provided on the air chambers for air intake and discharge. The second air pouch has an air duct which has a leak-proof element to receive air but prevent air from discharging so that air contained in the second air pouch is maintained in a saturated condition. In the event that the first air pouch is deflated due to cutoff of electric power or machine malfunction, the second air pouch can provide support to prevent the patient from directly contact the hard bedstead or suffering from discomfort.

The alternate and inflatable air mattress set forth above can reduce pressure on patient's blood circulation. In addition, the air pouches may be inflated alternately to lift patient's body to stimulate blood circulation. However, it cannot help patient to roll sideways or reduce sideway pressure. The stimulation effect for improving blood circulation is limited.

There is another type of air mattress being proposed in prior art that can help patients to roll sideways. The air mattress mainly includes a first air valve, a second air valve and an air mattress. The air mattress consists of a plurality of air pouches A, B, C, D and E. The air pouch A and air pouch B are located on one side, and the air pouch C and air pouch D are located on another side. The air pouches A and B are spaced from each other, and the air pouches C and D also are spaced from each other. The air pouches E are located on two sides of the air pouches A, B, C and D, and are higher than the air pouches A, B, C and D.

In addition, the air mattress has air piping connecting to a main intake air duct for linking to an external air pump. There is a central discharge air duct connecting to the air pouches E through the air piping. There is also an air duct A connecting to the air pouch A through the air piping, and a lower air duct A connecting to a first air duct through the air piping. There is an air duct B connecting to the air pouch D through the air piping. The air duct B also connects to a third air duct of a third air chamber through the air piping. The second air chamber has a second air duct connecting to the air pouch C through the air piping. The fourth air chamber has a fourth air duct connecting to the air pouch B through the piping. Thus users may turn rotary caps of the first air valve and the second air valve to inflate the air mattress completely, inflate the air mattress on one side, inflate one side alternately or intermittently, or inflate two sides alternately and intermittently.

While the air mattress mentioned above can generate up and down movements alternately through the air pouches A, B, C, and D to help patients rolling sideways and stimulate blood circulation, it cannot simultaneously help patients to roll sideways and generate alternate up and down movements. There are stillrooms for improvement.

SUMMARY OF THE INVENTION

The primary object of the invention is to provide an improved air mattress that has side pouches under two sides of air pouches so that a patient's body may have alternate up and down movements through the air pouches synchronously when doing sideway exercises thereby to get improved blood circulation.

More specifically, the air mattress of the invention includes a plurality of air pouches and side pouches. The side pouches are located longitudinally under the transverse air pouches. When the side pouches are inflated alternately, two sides of the air mattress may be lifted or lowered alternately to give patient sideway exercises and to alleviate the patient from undue blood circulation pressure.

The foregoing, as well as additional objects, features and advantages of the invention will be more readily apparent from the following detailed description, which proceeds with reference to the accompanying drawings.

DESCRIPTION OF THE PREFERRED EMBODIMENTS

Figure 1:
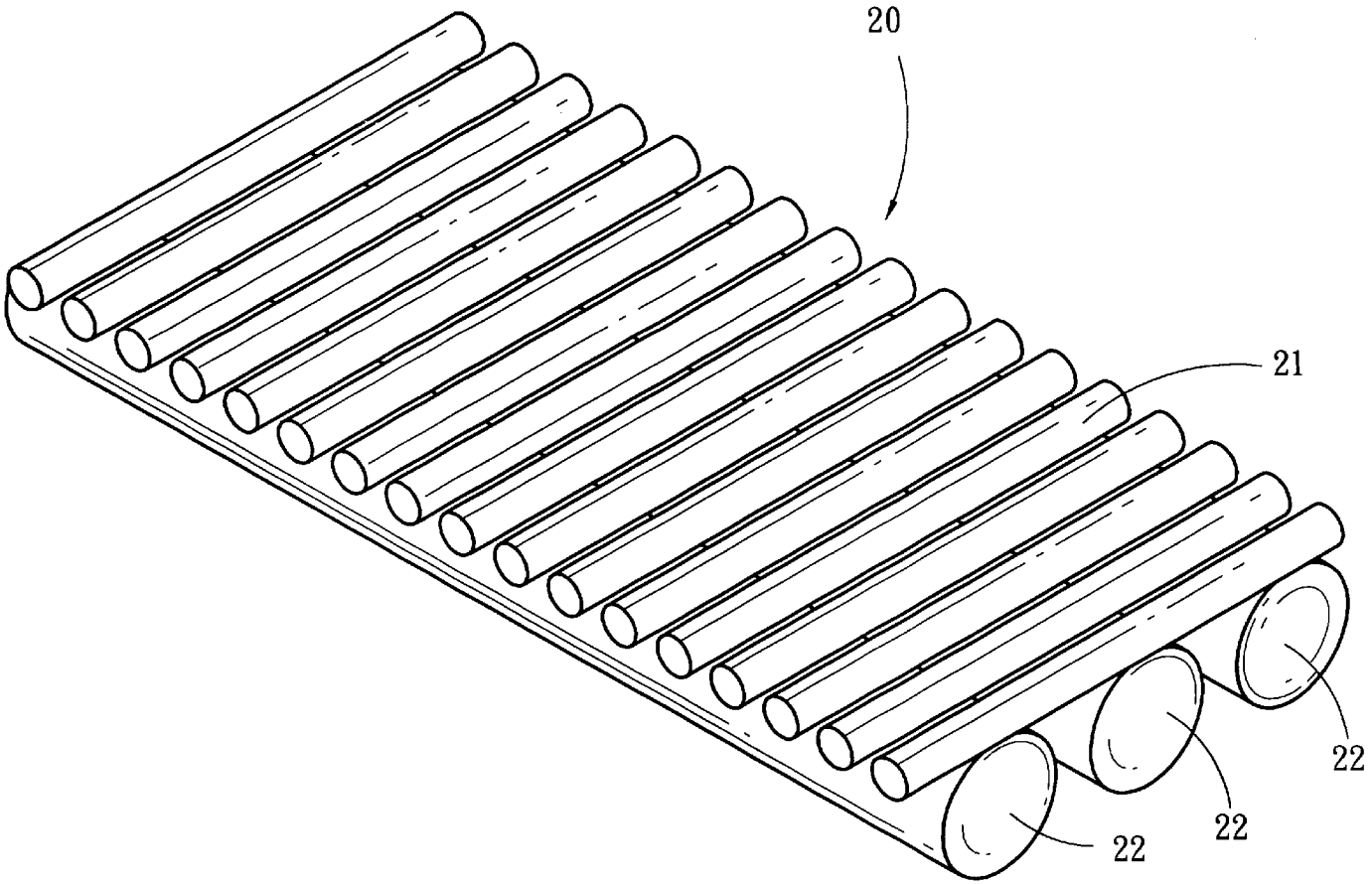
FIG. 1 is a perspective view of the present invention.

Referring to FIG. 1, the air mattress of the invention aims at providing a synchronous sideway rolling and alternate up and down movements.

Figure 2:
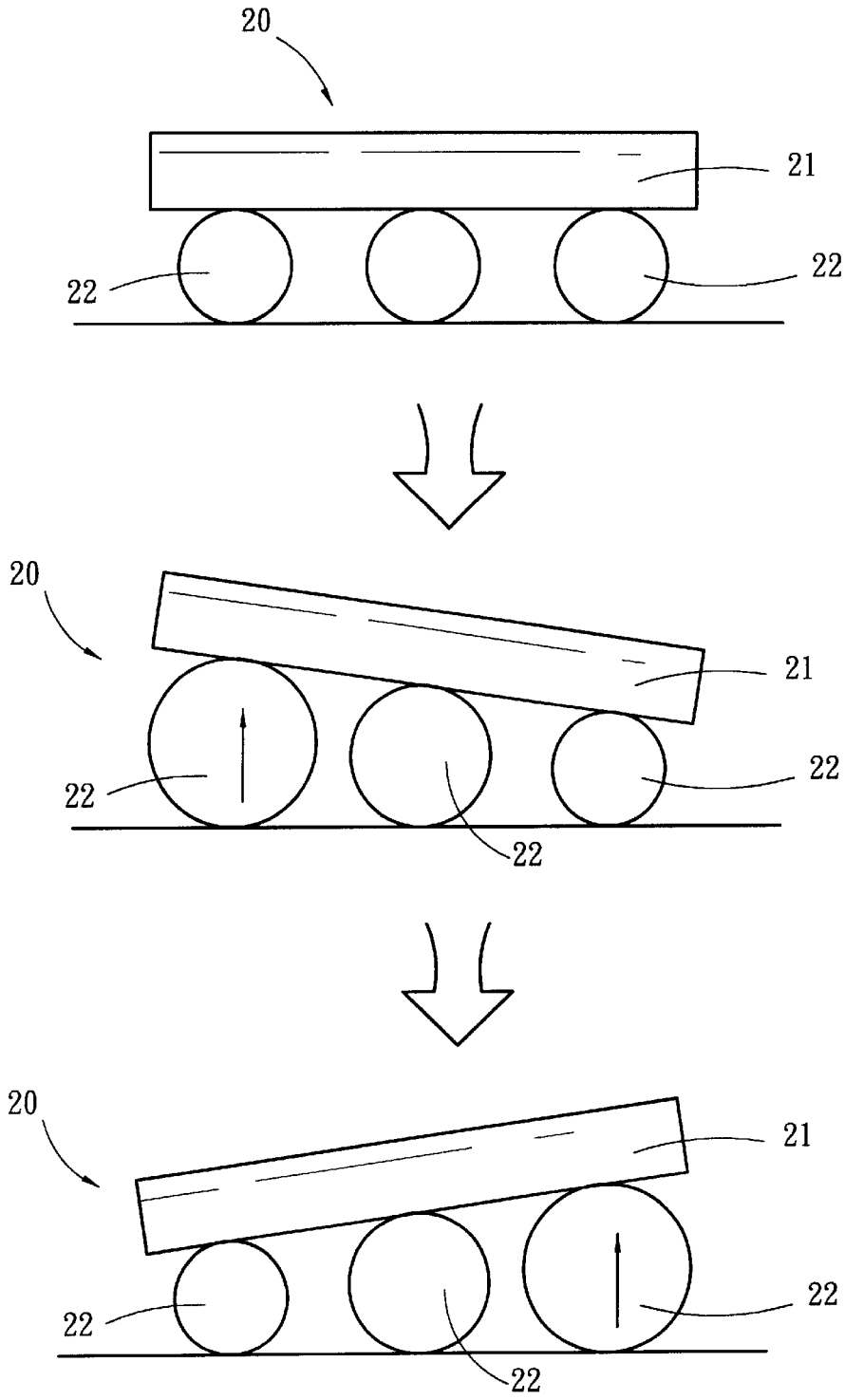
FIG. 2 is a schematic view of the present invention, showing various lifting conditions of the side pouches.
Figure 3:
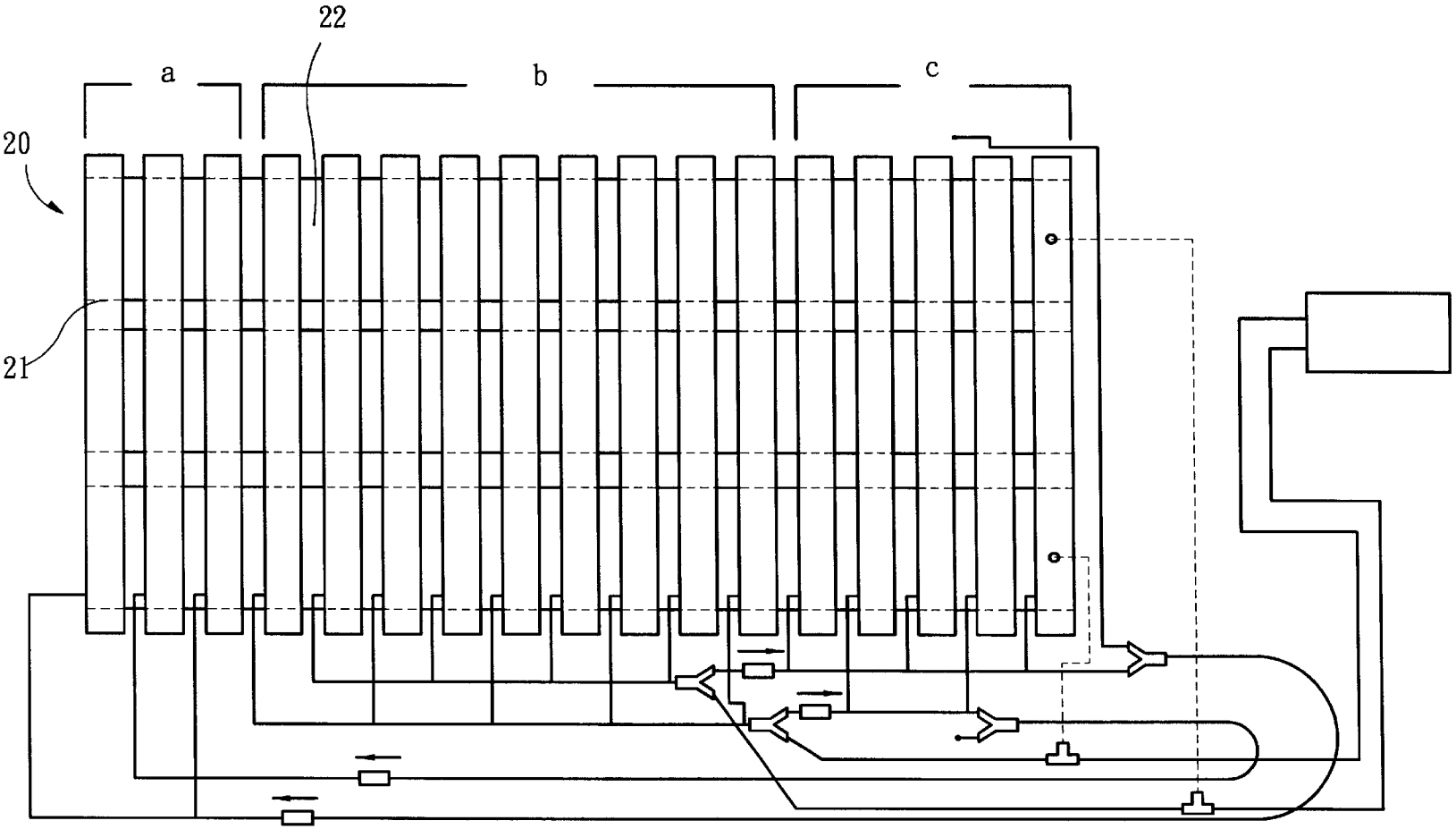
FIG. 3 is a schematic view of a piping configuration of the present invention.

The air mattress 20 of the invention consists of a plurality of transverse air pouches 21 and a plurality of longitudinal side pouches 22. The air pouches 21 are arranged alternately in up and down fashion to generate undulant movements to stimulate blood circulation of patients. The side pouches 22 are located longitudinally under the air pouches 21. The side pouch 22 located on any one side may be inflated (as shown in FIG. 2) to lift the air mattress on that side so that the patient lain on the air mattress 20 may be lifted sideways (about 8 to 30 degrees) to enable the patient lying on one side in an inclined manner.

The air mattress 20 of the invention consists of a plurality of transverse air pouches 21 and a plurality of longitudinal side pouches 22. The air pouches 21 are arranged alternately in up and down fashion to generate undulant movements to stimulate blood circulation of patients. The side pouches 22 are located longitudinally under the air pouches 21. The side pouch 22 located on any one side may be inflated (as shown in FIG. 2) to lift the patient sideways to enable the patient to lie on the air mattress on his/her side.

When the side pouches 22 under the air pouches 21 are inflated alternately, the patient lain on the air mattress 20 may be rolled and lifted sideways to do sideway exercises in an inclined manner. While the side pouches 22 of the air mattress 20 are used to move patient's body sideways, the air pouches 21 may be inflated alternately to move patient's body up and down in an undulant manner thereby to improve blood circulation. As patient's body may be rolled sideways left and right, and lifted or lowered dynamically, the body may be subject to different pressure on different areas. Moreover, The number and locations of the air pouches 21 and side pouches 22 may be altered to suit the heights and requirements of patients.

Figure 4:
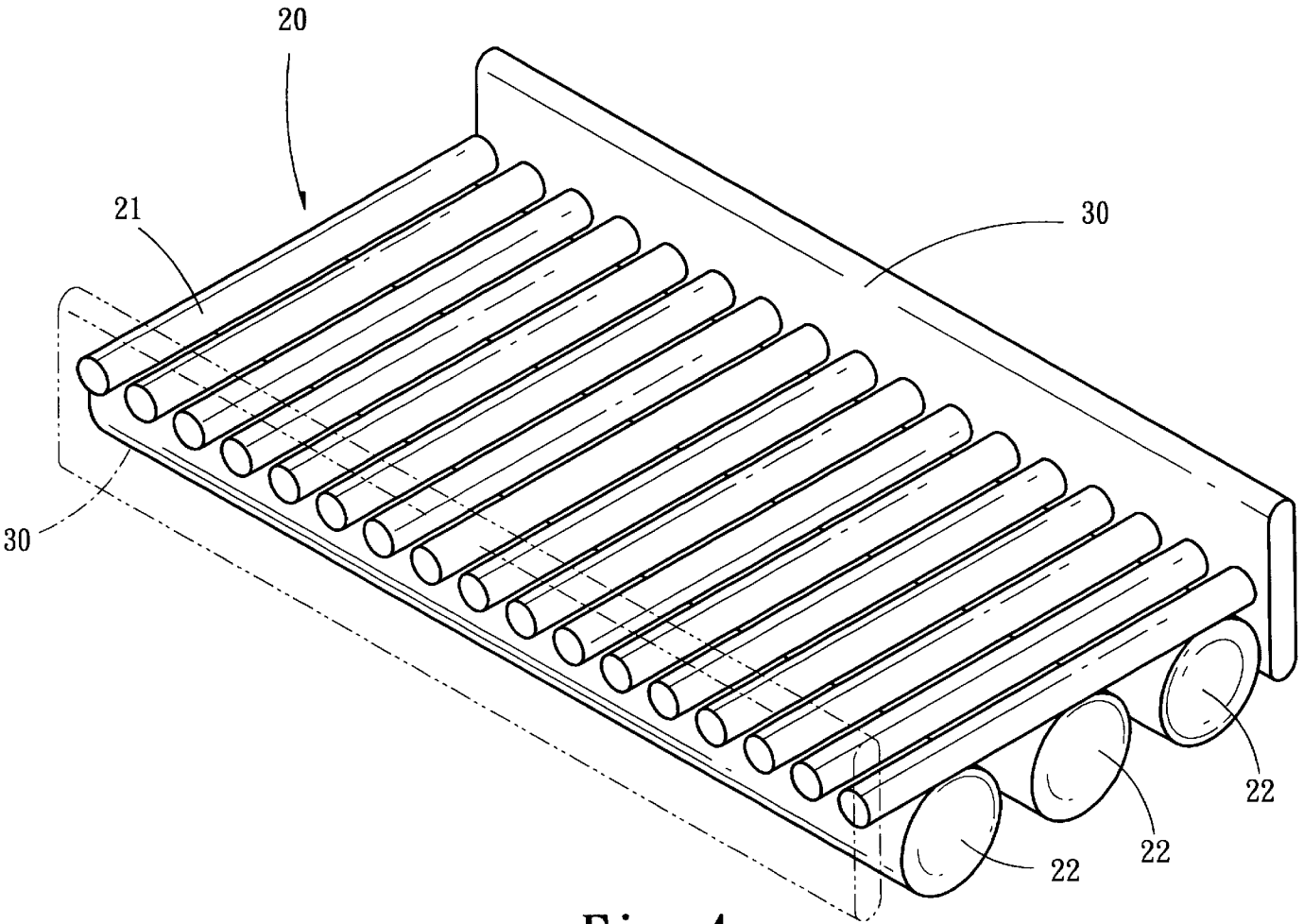
FIG. 4 is a schematic view of another embodiment of the present invention.

Refer to FIG. 4 for an embodiment of the invention adopted for practical use. The two lateral sides of the air mattress 20 may be added respectively with a guarding pouch 30 with a height greater than the air mattress 20, and a length extending from the first air pouch 21 to the last to prevent the patient from dropping out of the bed. As best seen in FIG. 4, guarding pouches 30 are connected to the transversely arranged air pouches 21, and extend above and below said air pouches 21.

By means of the construction set forth above, the air mattress of the invention can roll a patient's body sideways and stimulate blood circulation, thus provides more improved functions and benefits.

While the preferred embodiments of the present invention have been set forth for the purpose of disclosure, modifications of the disclosed embodiments of the present invention as well as other embodiments thereof may occur to those skilled in the art. Accordingly, the appended claims are intended to cover all embodiments, which do not depart from the spirit and scope of the present invention.

What is claimed is:

1. An air mattress with alternate lifting function, comprising:

seventeen transversely arranged air pouches;

a plurality of side pouches longitudinally located under the air pouches on two sides thereof; and two guarding pouches located on two lateral sides of the air mattress and connected to the transversely arranged air pouches, and extending above and below said transversely arranged air pouches, each guarding pouch having an elevation higher than the air mattress and a length extending from an upper end to a lower end of the air mattress for preventing the patient from dropping out of the air mattress, wherein the side pouches are inflatable alternately to incline the air mattress to lift a patient's body sideways, and the air pouches are inflatable alternately in an undulant fashion to alter pressing areas exerting on the patient's body such that the patient's body is not subject to pressure on a constant area for a prolonged period of time and is prevented from inflicting harmful effect.

* * * * *